US007461764B2

(12) United States Patent
Thompson

(10) Patent No.: US 7,461,764 B2
(45) Date of Patent: Dec. 9, 2008

(54) HAT ACCESSORY WITH INDICIA

(76) Inventor: Roger G. Thompson, 11965 Danforth Dr., Sterling Heights, MI (US) 48312

( * ) Notice: Subject to any disclaimer, the term of this patent is extended or adjusted under 35 U.S.C. 154(b) by 0 days.

(21) Appl. No.: 11/404,977

(22) Filed: Apr. 13, 2006

(65) Prior Publication Data

US 2006/0230497 A1 Oct. 19, 2006

Related U.S. Application Data

(63) Continuation-in-part of application No. PCT/US2004/018160, filed on Jun. 7, 2004.

(51) Int. Cl.
*A42C 1/04* (2006.01)

(52) U.S. Cl. ..... 223/14; 2/209.13

(58) Field of Classification Search ..... 223/84, 223/12, 14, 66; 2/209.13, 195.1
See application file for complete search history.

(56) References Cited

U.S. PATENT DOCUMENTS 5,012,531 A 5/1991 Schoonover
5,088,127 A * 2/1992 Thornock ..... 2/209.13
5,634,575 A 6/1997 Scharrenberg
5,862,522 A 1/1999 Cho
5,908,146 A 6/1999 Levin
5,991,927 A 11/1999 Barbaccia
6,115,846 A * 9/2000 Truesdale ..... 2/209.13
6,170,088 B1 * 1/2001 Tate ..... 2/209.13
6,315,175 B1 11/2001 Berger
6,655,558 B2 * 12/2003 Lawrence ..... 223/14
6,755,329 B2 6/2004 Thompson
7,097,080 B2 * 8/2006 Cox ..... 223/84
7,178,173 B2 * 2/2007 Kronenberger ..... 2/209.13

* cited by examiner

*Primary Examiner*—Danny Worrell
(74) *Attorney, Agent, or Firm*—Donald W. Meeker

(57) ABSTRACT

Disclosed herein is a hat accessory for engaging the visor or bill of a baseball cap or other hat with a forward extending visor or bill, the hat accessory comprising an indicia that may bear information, images, messages or the like related to sports teams, advertising, or any communication or expression desired.

20 Claims, 12 Drawing Sheets

HAT ACCESSORY WITH INDICIA

CROSS-REFERENCE TO RELATED APPLICATIONS

This application claims the benefit of and priority to prior filed co-pending U.S. patent application Ser. No. 10/770,137, filed on Feb. 2, 2004, the disclosure of which is incorporated herein by reference. This application is also a continuation-in-part of PCT Patent Application Ser. No. PCT/US04/18160, filed Jun. 7, 2004, the disclosure of which is incorporated herein by reference.

FIELD OF THE INVENTION

The present invention relates to hat accessories. More specifically, the invention relates to hat accessories for engaging the visor or bill of a baseball cap or other hat with a forward extending visor or bill, the hat accessory having an exposed upperside for the display of indicia that may bear information, images, messages or the like related to sports teams, advertising, or any communication desired.

BACKGROUND OF THE INVENTION

Base ball caps and other caps with bills are big sellers. Many hat manufacturers and buyers customize hats with an embroidered symbol, message or the like. The background art does not provide a hat accessory suitable for advertising by a promoter or self expression by a user by providing indicia on the hat accessory.

Many users desire to promote a specific team or product or show their support for a particular player, or dislike of a particular team or player, or have a custom message or expression that can be displayed on a cap bill. It is desirable to have the message or indicia on the cap bill, including powered indicia and programmable indicia. The indicia may also be interchangeable depending on the expression the user wishes to make. The user likewise wishes to obtain an agreement in arc of the bill while having the hat accessory in place.

While there have been many hat shaping devices and a number of devices for shaping the bill or visor of a baseball cap, none provide advertising or self expression by providing indicia on the hat accessory.

U.S. Pat. No. 5,634,575, issued Jun. 3, 1997 to Scharrenberg, concerns an apparatus and method for reforming a visor of a baseball type cap including a flexible member to be positioned adjacent the visor and having retention plates along the sides or center thereof that form visor receiving slots to position and retain the visor during reforming. Clips may be used in lieu of slots to retain the visor. Straps or similar elongated devices are affixed to the sides of the flexible member and are tensioned to draw said sides together thereby imparting an increased angular contour to the visor, wherein the straps stretch straight across the bill between the bent down sides, so that if the cap were worn with the device attached, the view of the wearer would be blocked by the straps. Latches on the straps hold the desired tension and visor contour until the visor has assumed the new contour set. The method may include moisturizing the visor and may be performed iteratively to permit various intermediate contours to be sampled or as required to provide the desired semi-permanent visor set.

U.S. Pat. No. 5,991,927, issued Nov. 30, 1999 to Barbaccia, provides a shaping device wherein the bill of the cap fits into the shaping device such that the bill is shaped into the shape of the bill-shaping wall. The bill-support wall preferably further includes indicia of team enthusiasm and loyalty and a transparent plastic card-holder for storing and displaying a baseball card. The device is not wearable on the head of a wearer and would immediately slip off in active use.

U.S. Pat. No. 6,315,175, issued Nov. 13, 2001 to Berger, puts forth a device for reforming the brim of a cap having a flexible frame constructed of two flexible members and a third, hinged arcuate member, of rigid construction is provided. The two flexible members are attached to the top of the curved, rigid, bottom member and are maintained in a parallel relationship regardless of the degree of articulation of the bottom member around the hinge. This construction allows the user to insert a cap brim into the parallel slot and bend the device thereby imparting a variable degree of curvature to the brim of the cap. A ratchet device is connected to the bottom member to allow the device to be adjusted or set in a specific position to impart the desired curvature to the brim. In addition, the device has a mounting hook at one end for hanging so that it can be used as a storage or display device while the cap is retained therein. The cap is not wearable with the device in place.

U.S. Pat. No. 5,908,146, issued Jun. 1, 1999 to Levin, discloses a device for bowing the brim of a cap and for storing, transporting, washing and/or displaying such cap having a body portion with first and second retention arms extending upwards at each end thereof forming first and second receipt areas at their junctions for receipt therein of the first side and second side of the cap brim, to form such brim into a desired curve. Notches can be disposed inward of each of the receipt areas for receipt of one side of the brim to form alternate brim receipt areas for different desired brim curvatures. The cap is not wearable with the device attached.

U.S. Pat. No. 5,012,531, issued May 7, 1991 to Schoonover, claims a form retaining holder or case for a visored cap comprising an upper shell and a lower shell, both shell portions sized and adapted to accommodate a visored type cap, such as used in the game of baseball, when the back portion of the cap is folded forwardly into the interior of the front portion of the cap. In such a holder, the cap is interposed between the upper shell and lower shell so that the form of the cap is retained during carriage and storage, and some modicum of protection for the cap is provided. The upper shell and lower shell are connected by means of known fastening means and by a lip disposed on the lower surface of the visor portion of the upper shell, such lip adapted to engage the visor of lower shell therein. Ventilation holes may be provided both upper and lower shell portions, particularly in portions adjacent to the periphery of the crown portion of the cap where it closely accommodates the wearer's head. The device covers the entire front of the cap and would therefore cover the insignia on the cap and be undesirable for wearing. The presence of the device would alter the cap size and therefore also be undesirable for wearing.

U.S. Patent No. 6,755,329, issued Jun. 29, 2004 to the assignee of the present invention, the specification of which is hereby incorporated by reference, discloses a hat shaping device. However, the communication and advertising opportunities available were not disclosed in the '329 patent.

What is needed is a hat accessory for engaging the bill of a ball cap providing indicia as a means for advertising and a means of self expression.

SUMMARY OF THE INVENTION

A hat accessory for engaging a bill of a cap comprises an arcuate crown slightly greater in length than a width of a bill of a cap, the crown comprising an exposed upperside and an underside, where the underside is adapted to contact a top surface of the cap bill. A pair of retainer edge strips extending from opposing ends of the crown, where each retainer edges are adapted to contact a side edge of the cap bill. A pair of tabs, where each tab extends from each edge strip. The tabs are spaced from the crown to form a gap slightly smaller than the thickness of a cap bill for securely gripping a side edge portion of the cap bill, whereby the hat accessory is selectively secured to a cap bill by inserting the cap bill into the hat accessory where the tabs function to securely grip the hat accessory to the cap bill. The hat accessory is a unitary device formed of a semi-rigid material and adapted to cause the cap bill and said crown of the hat accessory to conform to generally the same contour. At least one indicia located on the exposed upperside of said crown.

Additionally, the indicia may be powered, such as by electrical power. In one embodiment, the indicia is magnetically attachable to the crown. The indicia may include a light emitting element, such as a light pipe or electroluminescence device or array.

In an alternative embodiment, a hat accessory for engaging a bill of a cap comprises an arcuate crown approximately equal in length to the width of a bill of a cap, the crown comprising an exposed upperside and an underside.

An attachment assembly comprising a shaper strip about equal in length to the width of a cap bill and a pair of retainer edge strips, each said edge strip extending from opposing ends of the shaper strip, where each retainer edges are adapted to contact a side edge of the cap bill. A pair of crown retaining channels, the channels providing means to secure the crown to the shaper strip. A pair of tabs, each tab extending from each of said edge strips, said tabs being spaced from said shaper strip to form a gap slightly smaller than the thickness of a cap bill for securely gripping a side edge portion of the cap bill, whereby the hat accessory is selectively secured to a cap bill by inserting the cap bill into the hat accessory. The tabs function to securely grip the hat accessory to the cap bill. The attachment assembly is formed of a semi-rigid material so that the attachment assembly causes the cap bill and the crown of said hat accessory to conform to generally the same contour. At least one indicia is located on the exposed upperside of said crown. The crown may be formed of any suitable material known in the art.

Further objects, features and advantages of the present invention will become apparent to those skilled in the art from analysis of the following written description, the accompanying drawings and the appended claims.

DESCRIPTION OF THE PREFERRED EMBODIMENT

Figure 2:
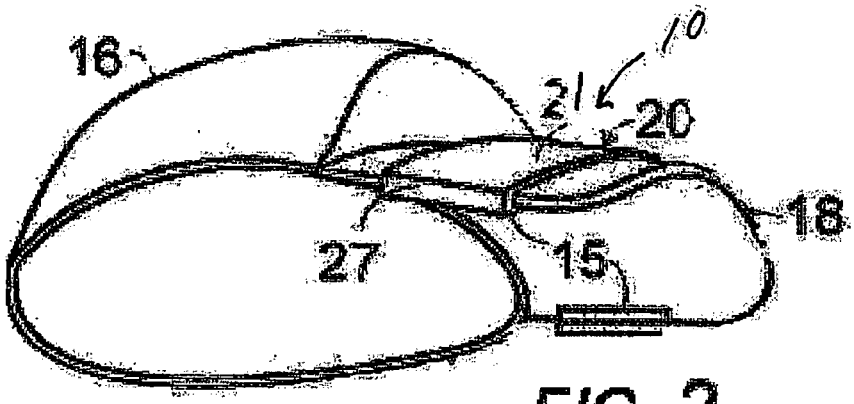
FIG. 2 is a perspective view showing the underside of the hat accessory of FIG. 1 installed on the cap bill.
Figure 3:
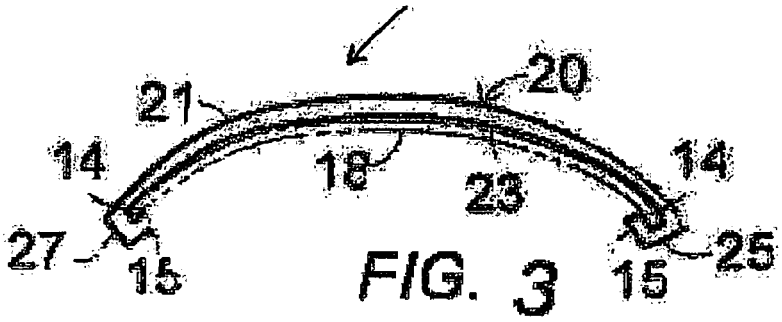
FIG. 3 is a front elevational view of the hat accessory of FIG. 1.
Figure 4:
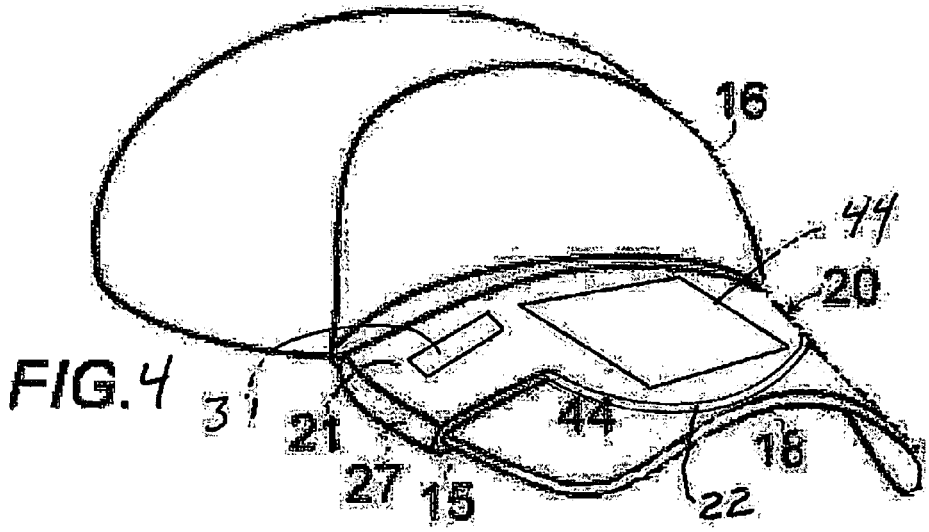
FIG. 4 is a perspective view showing the top of the hat accessory of the present invention with powered indicia displayed and a photovoltaic device included on the crown, as the hat accessory is installed on the cap bill.

With initial reference to FIGS. 1-6, the hat accessory 10 of the present invention with indicia 44 displayed as the hat accessory 10 is installed on a cap bill 18 is shown. The hat accessory 10, for engaging the bill 18 of a baseball type cap 16 or other cap having a front visor or bill 18, comprises an arcuate crown 20 slightly greater in length than a width of a cap bill 18. The crown 20 has an exposed upperside 21 and an underside 23. The upperside 21 may bear an indicia 44 imprinted, embossed, burned or otherwise applied to the upperside 21 of the bill shaper device and exposed to view. The underside 23 is adapted for contacting a top surface of a cap bill 18. In the embodiment of FIG. 4, the crown 20 has a forward extending portion 22 to provide additional surface area for the indicia 44.

A pair of retainer edge strips 25 and 27 extend from an opposing end of the crown 20. A pair of tabs 15 extend from the retainer edge strips 25, 27. The tabs 15 are spaced from the crown 20 to form a gap 14 slightly smaller than the thickness of the cap bill 18. The retainer edge strips 25, 27 contact a side edge of the cap bill 18 wile the tabs 15 securely grip a side portion of the cap bill 18, whereby the hat accessory 10 is selectively secured to a cap bill 18 by inserting the cap bill 18 into the hat accessory 10 where the tabs 15 function to securely grip the hat accessory 10 to the cap bill 18.

The hat accessory 10 in the present embodiment is a unitary device and is preferably fabricated of a semi-rigid material, such as a molded plastic or nylon or rubberized plastic or any other suitable material known in the art. The hat accessory 10 is preferably fabricated in one piece of a semi-rigid material to cause the cap bill 18 and the crown 20 of said hat accessory 10 to conform to generally the same contour or arc agreement.

Figure 1:
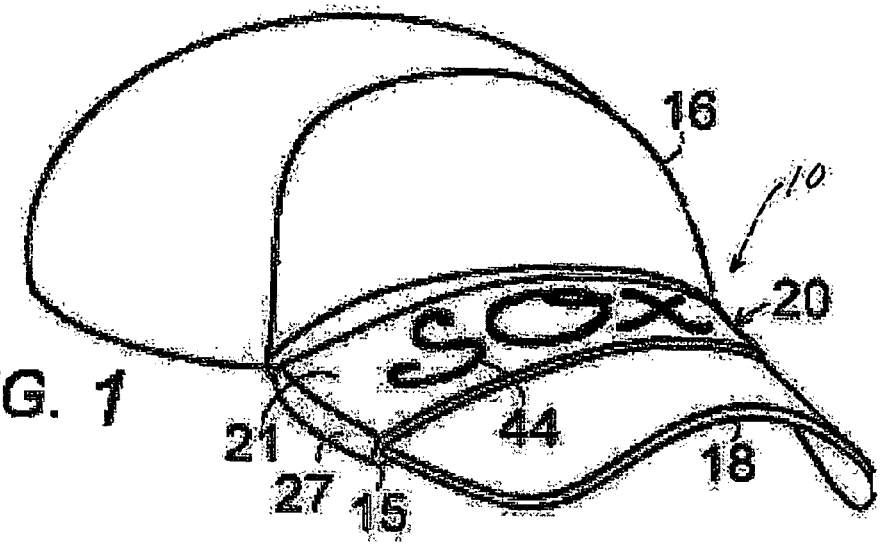
FIG. 1 is a perspective view showing the top of the hat accessory of the present invention with an indicia displayed as the hat accessory is installed on a cap bill.

In FIGS. 1-3 the exposed upperside 21 of the crown 20 is adapted for receiving indicia 44 applied thereto, such as sports related information or personal information or advertisements or any type of imprinted or otherwise applied words and images, including decals. The hat accessory 10 is easily removable and replaceable with others bearing different indicia 44.

Figure 5:
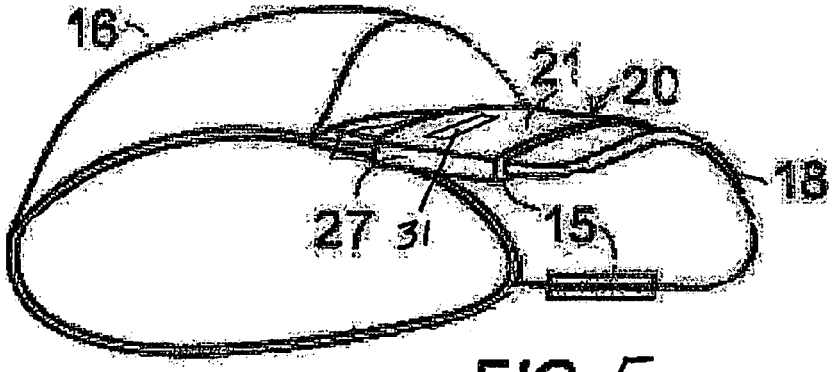
FIG. 5 is a perspective view showing the underside of the hat accessory of FIG. 4 installed on the cap bill.
Figure 6:
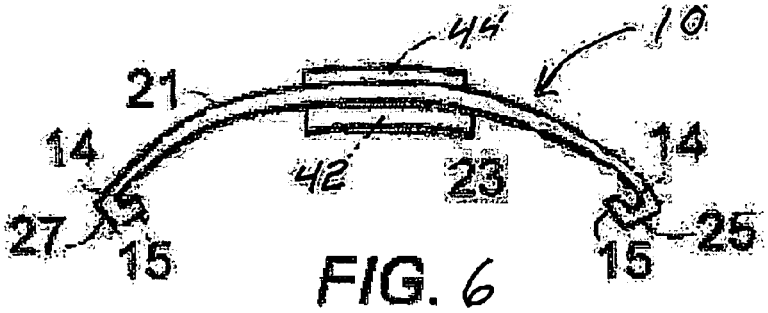
FIG. 6 is a front elevational view of the hat accessory of FIG. 4 having a powered indicia and a photovoltaic device disposed on the crown and a electrochemical storage device disposed on the underside of the hat accessory to provide power to the powered indicia disposed on the crown.

In FIGS. 4-6 alternative embodiments of the hat accessory 10 of the present invention are shown where the indicia 44 is powered, such as by electrical power or light energy. A power source 42 is operatively coupled to a consumption location, such as powered indicia 44, by any means known in the art, for example, by optically or electrically conductive material. A microprocessor (not shown), memory storage (not shown) and may be provided to The indicia 44 may include one or more light emitting elements, such as a light pipe or an electroluminescence component, system or array. Additionally the indicia 44 may employ one or more LCDs (liquid crystal display), LEDs (light emitting diode), plasma or a fiber optics light emitting device. The indicia may be a novelty device, such as a "mood detector", a "truth detector" a display that communicates a static message or a user programmable message. Additionally, other items may be disposed on the hat accessory 10, including a miniature train (not shown) or a toy barking dog (not shown), as examples.

Power electronics 48 may be employed to programmably control the powered indicia 44. The indicia 44 may receive a signal from a memory storage device (not shown) to provide instructions to play a message. As such, the indicia 44 may receive a signal to provide a flashing display, a non-flashing display, or a video clip, as examples. Although not shown, the hat accessory 10 may also include an antenna for receiving a signal from a wireless source. Additionally, electronics for converting a signal to sound signals or video signals may be employed in the present embodiment. Other technology may be included, such as a photovoltaic device 31 to power the indicia 44 or power electronics 48, a power source 42, such as a electrochemical storage device may also be provided with the hat accessory 10. The indicia 44 and accessories enhance the advertising and self expression features of the present invention.

Referring now to FIGS. **7-9*b* a perspective exploded view of an alternative embodiment of the hat accessory 10 of the present invention is shown, with the crown 20 as a separate component having an indicia 44 displayed. An attachment assembly 50 is installed on the cap bill 18 having a power source 42 disposed thereon. A pair of channels 15B are disposed adjacent to retainer edge strips 25A and 27A at each end of a shaper strip 52. In the immediate embodiment, the shaper strip 52 is disposed below the cap bill 18. Tabs 2, spaced from the crown 20 slide into gaps 5 formed within channels 15B to secure the crown 20 to the attachment assembly 50. The tabs 2 or tabs 4 may be ribbed, for example, to assist in the maintenance of the position of the crown 20. The attachment assembly 50 and crown 20 may include conductive material (not shown), either optical or electrical, for example, to conduct energy from a power source to a consumption location, such as a powered indicia 44. For example, conductive material may be disposed in channels 1 and 15**B to transmit energy.

Figure 7:
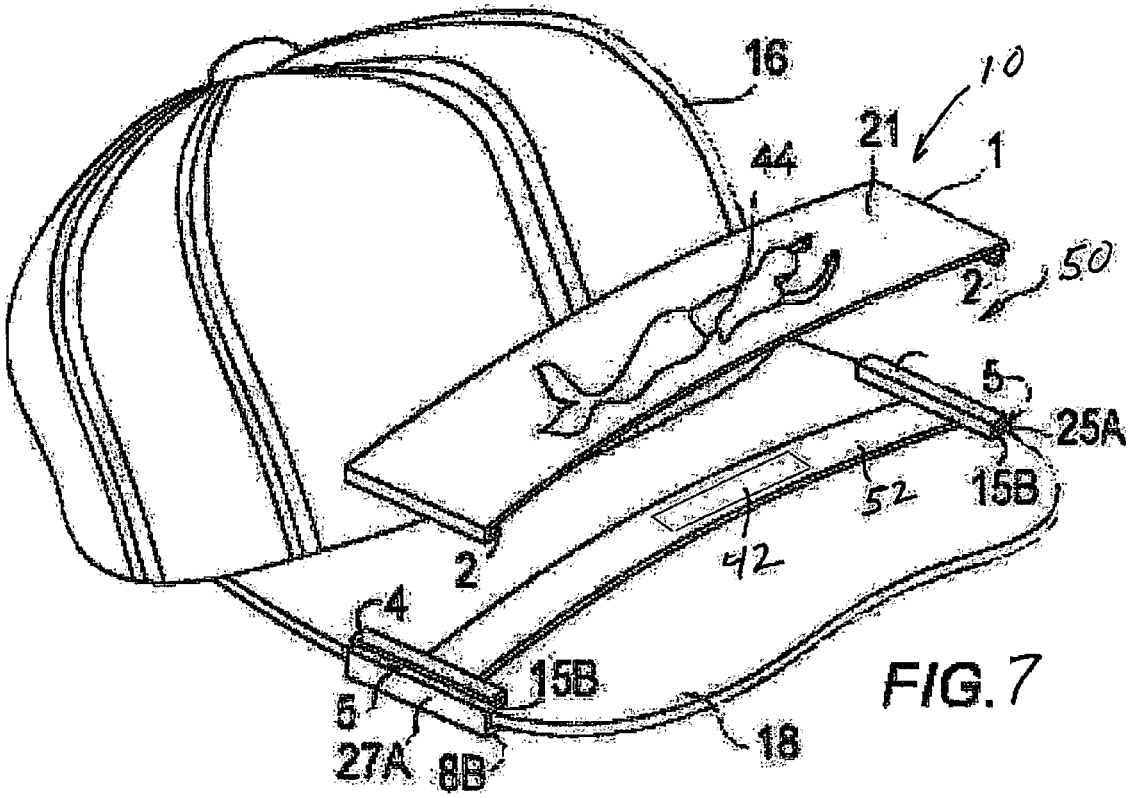
FIG. 7 is a perspective exploded view of an alternative embodiment of the hat accessory of the present invention, with the crown as a separate component having an indicia displayed thereon and an attachment assembly installed on the cap bill having a power source disposed thereon.
Figure 8:
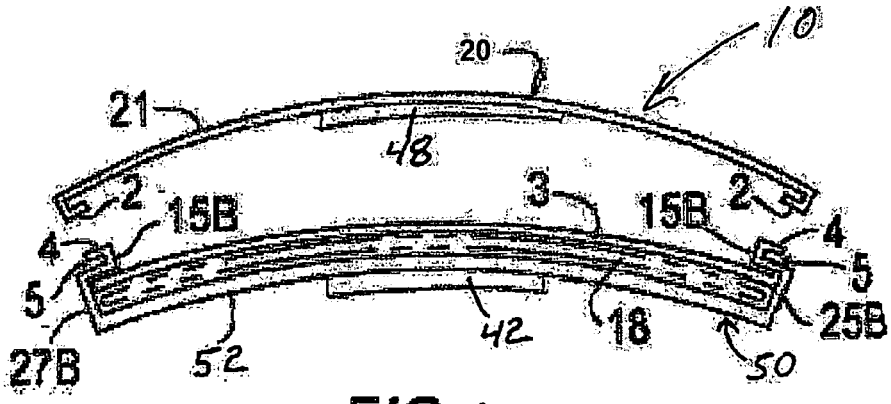
FIG. 8 is a front elevational view of an alternative embodiment of FIG. 7, revealing a power source on the attachment assembly and power electronics disposed on the underside of the crown.

Referring now to FIG. 8, a front elevational view is shown of an alternative embodiment of FIG. 7, revealing a power source 42 on the attachment assembly 50 and power electronics 42 disposed on the underside of the crown 20 to drive, for example, a programmable indicia 44. The shaper strip 52 is about equal in length to the width of a cap bill 18 and a pair of retainer edge strips 27B, 25B, each of which extends from opposing ends of the shaper strip 52, are adapted to contact a side edge of the cap bill 18. A pair of crown retaining channels 15B provide means to secure the crown 20 to the attachment assembly 50 and the bill 18. A pair of tabs 4 spaced from the shaper strip 52 form a gap 5 to permit the tabs 2 to slide into the channels 15B. The attachment assembly 50 is formed of a semi-rigid material so that the attachment assembly 50 causes the cap bill 18 and the crown 20 of the hat accessory 10 to conform to generally the same contour. At least one indicia 44 is located on the exposed upperside 21 of the crown 20. The crown 20 may be formed of any suitable material known in the art. The crown 20 is preferably manufactured from a polymer, but could be manufactured from aluminum or thin steel.

Figure 9:
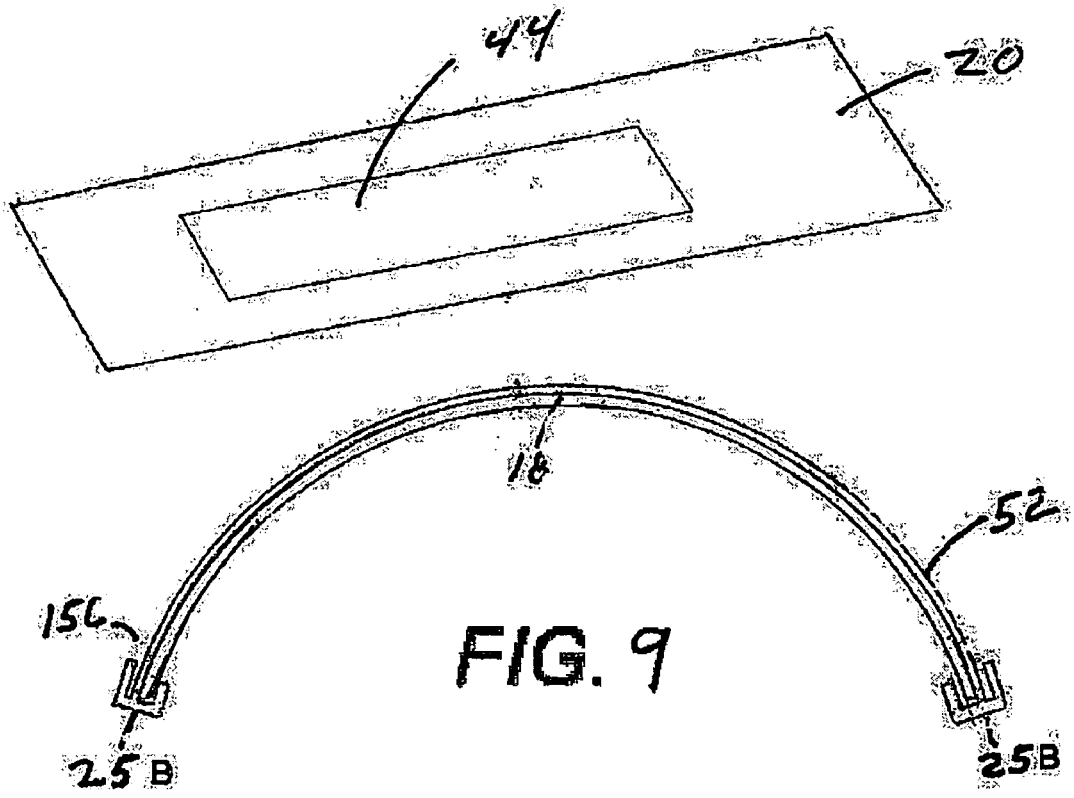
FIG. 9 is a front elevational view of an alternative embodiment of the attachment assembly of FIG.8 installed on the cap bill, where the shaper strip is located above the bill.
Figure 9A:
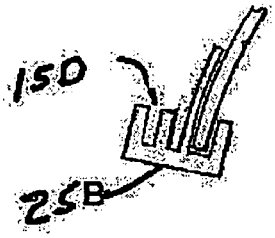
FIG. 9*a* is a partial front elevational view of an alternative embodiment of the attachment assembly of FIG. 9 installed on the cap bill, where the shaper strip is located above the bill and the channel for the crown is spaced from the crown.
Figure 9B:
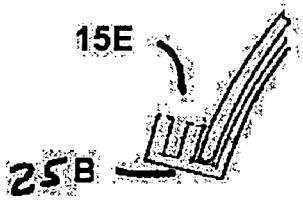
FIG. 9*b* is a partial front elevational view of an alternative embodiment of the attachment assembly of FIG. 9 installed on the cap bill, where the crown is located below the bill and the channel for the crown is disposed adjacent to the bill.

Referring now to FIG. 9, a front elevational view of an alternative embodiment of the attachment assembly 50 of FIG.8 is shown installed on the cap bill 18, where the shaper strip 52 is located above the bill 18. Channels 15C are disposed at either end of the shaper strip 52. FIG. **9*a* is a partial front elevational view of an alternative embodiment of the attachment assembly 50 of FIG. 9 installed on the cap bill 18, where the crown 20 is located above the bill and the channels 15D for the crown 20 is spaced from the shaper strip 52. FIG. 9*b* is a partial front elevational view of an alternative embodiment of the attachment assembly 50 of FIG. 9 installed on the cap bill 18, where the crown 20 is located below the bill 18 and the channels 15**E for the crown is disposed adjacent to the bill.

Figure 10:
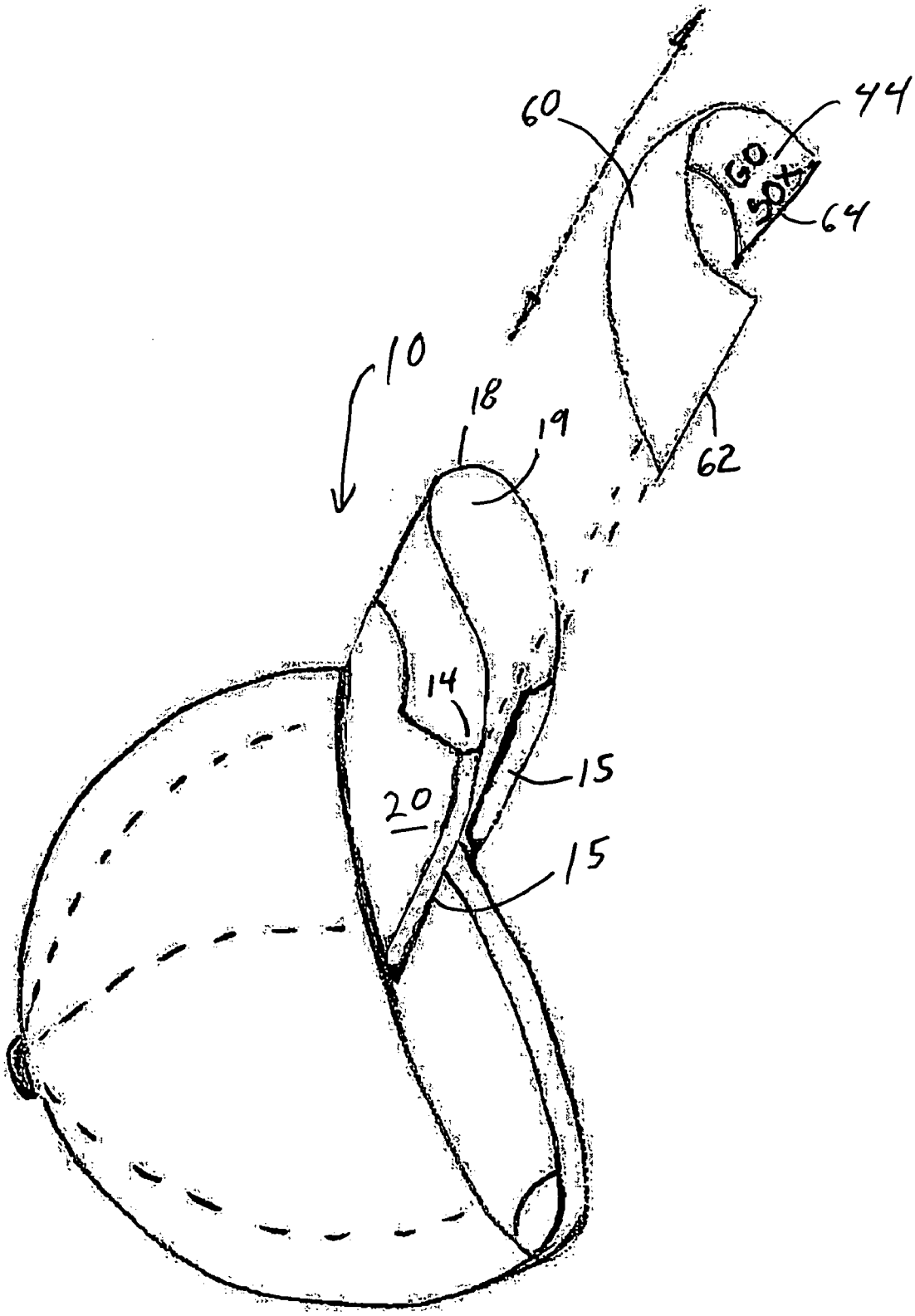
FIG. 10 is a perspective view of an alternative embodiment of the hat accessory of the present invention installed on the cap bill, having a display strip provided to be disposed at the underside of the cap bill, the display strip having an indicia displayed thereon.

Referring now to FIG. 10 a perspective view of an alternative embodiment of the hat accessory 10 of the present invention is shown installed on a cap bill 18, including a display strip 60 provided to be disposed at the underside 19 of the cap bill 18. In use, edge portions 62, 64 of the display strip 60 are disposed between the tabs 15 of the hat accessory 10 and a side portion of the cap bill 18. The gap 14 between the crown 20 and tabs 15 may be increased to accommodate the additional thickness that results from placing the display strip 60 and bill 18 into the gap 14. The display strip 60 has an indicia 44 displayed thereon. The present embodiment of the hat accessory 10 permits indicia 44 to be disposed at the underside 19 of the cap bill 18.

Figures 11, 11A:
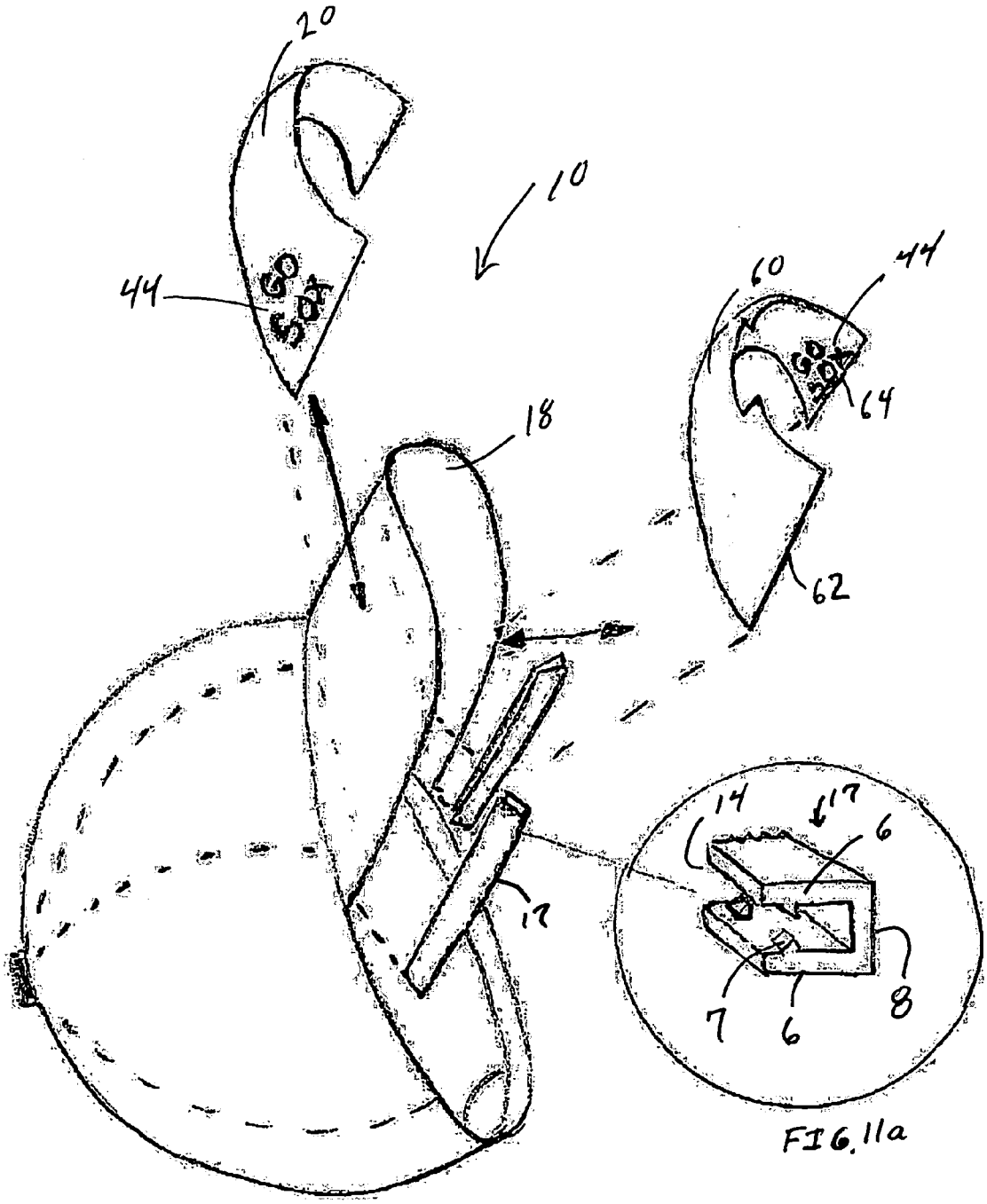
FIG. 11 is an exploded perspective view of an alternative embodiment of the hat accessory of the present invention, with a crown as a separate piece, a display strip and a pair of channels as separate pieces.
FIG. 11*a* is a perspective view of one of the pair of channels of FIG. 11.

Referring now to FIG. 11, an exploded perspective view of an alternative embodiment of the hat accessory 10 of the present invention is shown. A pair of channels 17 secure a crown 20 and a display strip 60 to the bill 18. The channels 17 may include conductive material (not shown) for conducting electrical or optical signals or power between the crown 20 to the display strip 60. Referring now also to FIG. 11*a,* a perspective view of one of the pair of channels 17 is shown. Each channel 17 includes a pair of tabs 6 extending from an edge 8 to form a gap 14. At least one finger 7 may be provided to assist in securing the channels 17 to the crown 20 and the display strip 60. In the preferred embodiment of the exemplary embodiment of FIG. 11*a,* there are four fingers 7, each disposed adjacent to an end portion of a tab 6.

Figure 12:
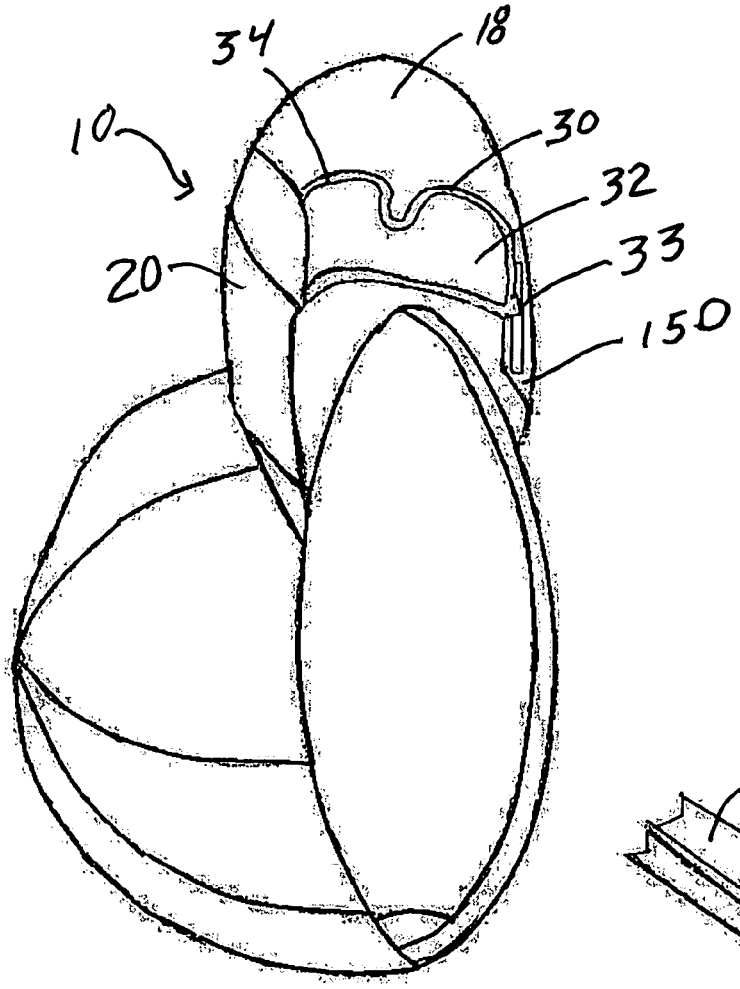
FIG. 12 is a perspective view of an alternative embodiment of the hat accessory of the present invention installed on the cap bill, including selectively engageable eyewear pivotally attached to each of a pair of tabs.

Referring now to FIG. 12, a perspective view of an alternative embodiment of the hat accessory 10 of the present invention having selectively engageable eyewear 30 is shown. The hat accessory 10 of the present embodiment is shown installed on the cap bill 18, permitting the user to engage the eyewear in front of the users eyes and when not desired, to pivot the eyewear up toward the bill 18 of the ball cap 16. The eyewear 30 includes at least one lens 32 which is attached to the tabs 15D of the hat accessory 10. The eyewear 30 is pivotally attached to the tabs 15D of the hat accessory 10 via mounts 33. The mounts 33 are slidably supported in slots 11 disposed within the tabs 15. The eyewear 30 may include a frame 34 to provide additional rigidity and support to the lens 32. The lens 32 is employed by pivoting the lens 32 about the mounts 33 and slidably positioning the lens 32 by sliding the mounts 33 within the slots 11. When not in use, a user may pivot the lens 32 out of the way so that the lens 32 is about parallel to the bill 18.

Figure 12A:
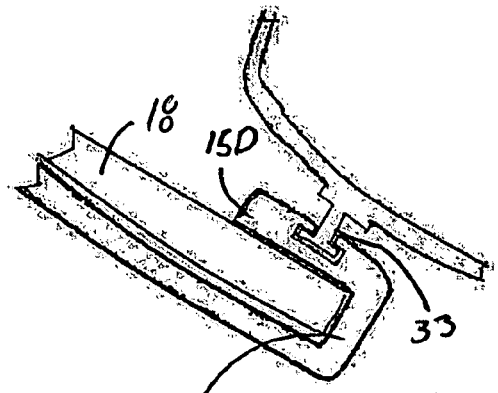
FIG. 12*a* is a partial cross sectional of the hat accessory of FIG. 12, cut through a pivot point.

Referring now also to FIG. 12*a,* a partial cross sectional of the hat accessory of FIG. 12 having selectively engageable eyewear 30 is shown, cut through a pivot point. A pair of retainer edge strips 25 and 27 extend from opposing ends of the crown 20. The tabs 15D extend from the retainer edge strips 25, 27. Each tab 15D has a slot 11 disposed generally along the edge strips 25, 27 to permit the mount 33 to translate within the slot 11. In the present embodiment, each mount 33 is trapped within the slot 11.

Figure 13:
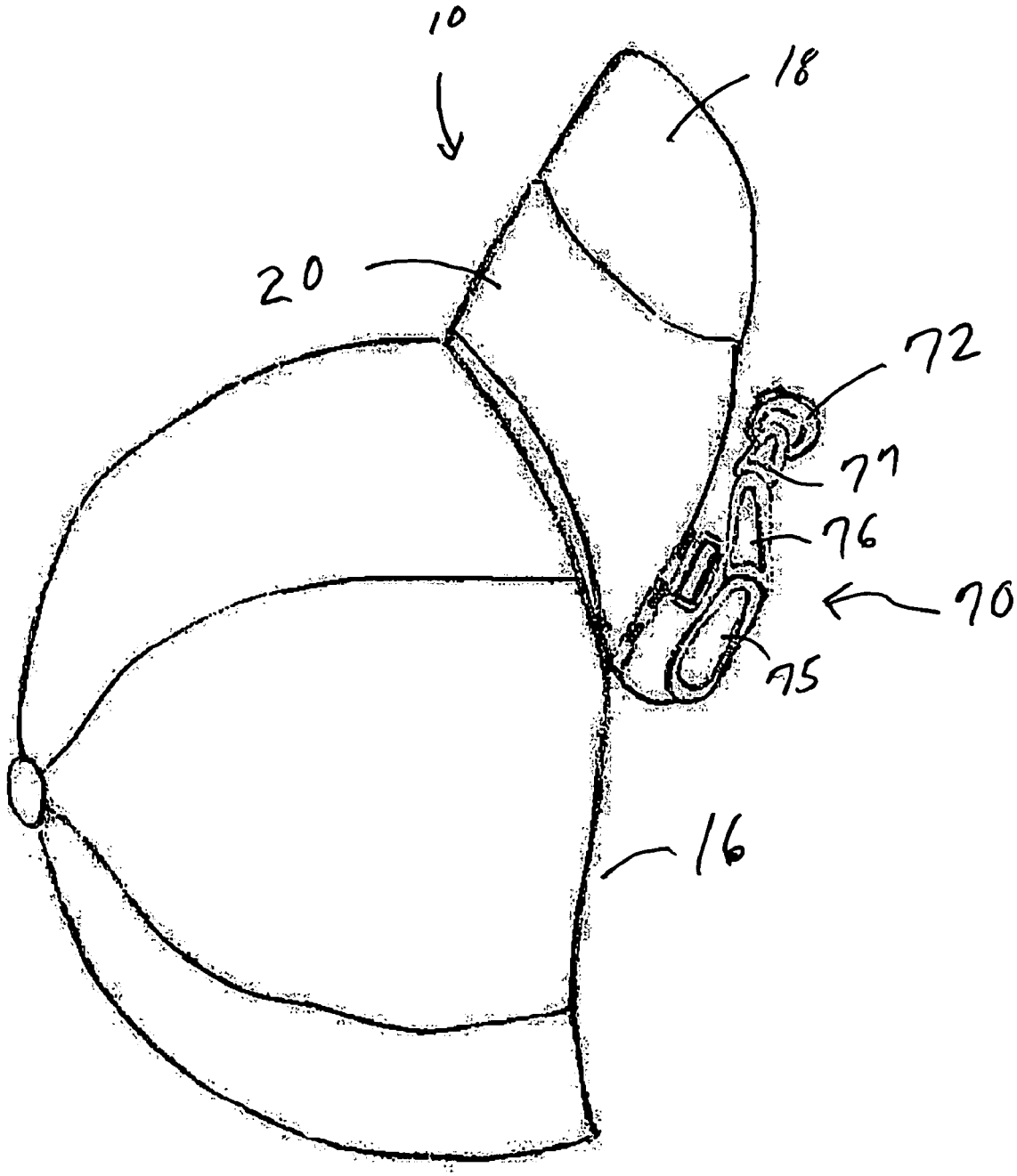
FIG. 13 is a perspective view of an alternative embodiment of the hat accessory of the present invention installed on the cap bill, having a speaker adjustably mounted thereon.

Referring now to FIG. 13, a perspective view of an alternative embodiment of the hat accessory 10 of the present invention having a media player 70 is shown. The immediate embodiment of the hat accessory 10 of the present invention comprises an adjustable boom 74 securely attached to the crown 20 at a first end. A speaker 72 is adjustably attached to boom 74 at a second end. In the preferred embodiment, the boom 74 is a comprised of multiple segmented members 75, 76, 77, that are pivotally attached to one another. Electronics (not shown) for converting a signal or data to sound signals or video signals are employed in the present embodiment. The speaker 72, is operatively coupled to the electronics by any means known in the art, including, electrical signals, optical signals or radio signals. The electronics may be disposed within the boom 74, or above or below the crown 20 of the hat accessory 10. The electronics may receive data from memory storage (not shown) or signals from a radio source, and produce a signal to be conducted to the speaker 72. Although not shown, in one embodiment of the present invention, an antenna is provided for receiving a signal from a wireless source. Other technology may be included, such as a photovoltaic device (not shown) or electrochemical storage device (not shown) to power the electronics and speaker 72.

Figure 14:
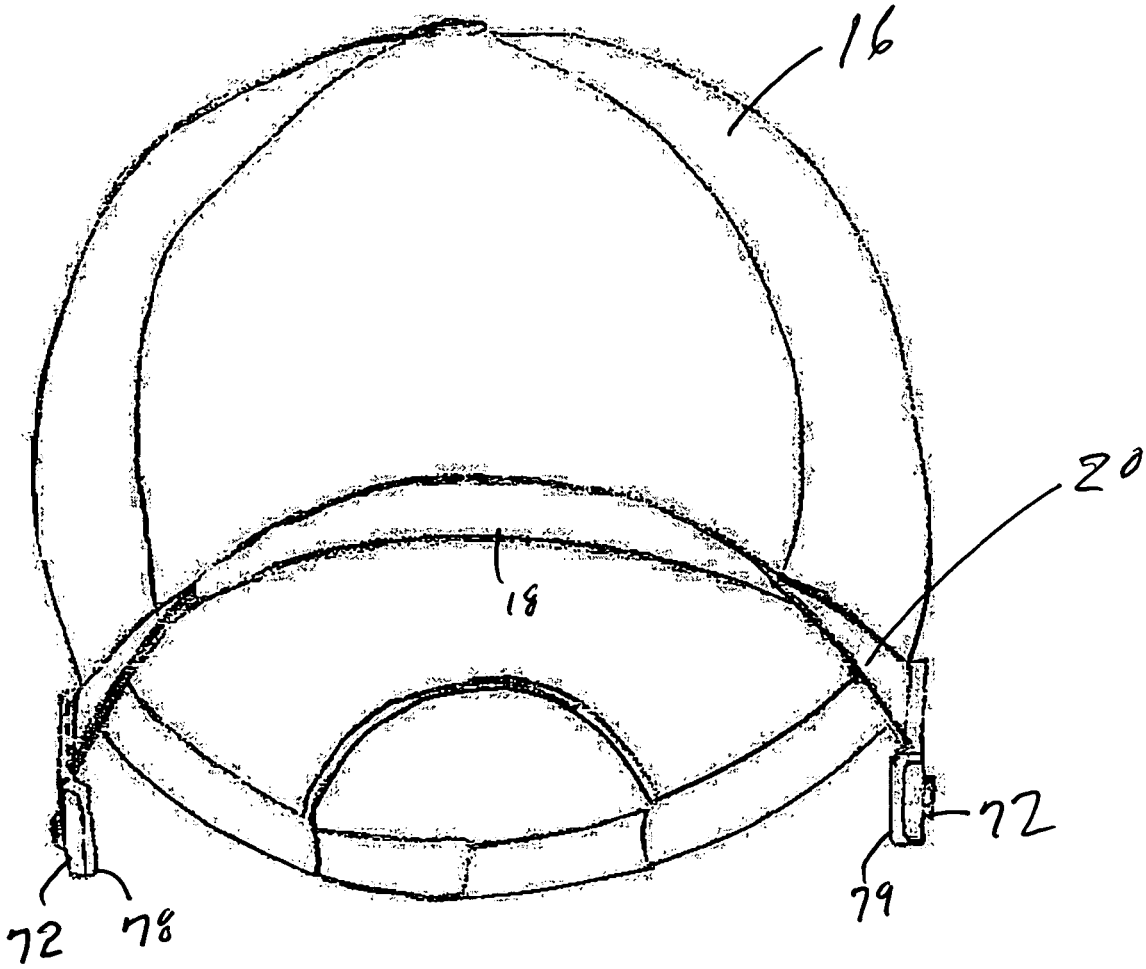
FIG. 14 is a perspective view of an alternative embodiment of the hat accessory of the present invention installed on the cap bill, having a pair of speakers mounted thereon.

Referring now also to FIG. 14, a perspective view of an alternative embodiment of the hat accessory 10 of the present invention of FIG. 13 is shown. In the immediate embodiment, a pair of supports 78, 79 extend from the crown 20 adjacent to edge strips 25, 27. A pair of speakers 72, 73 are detachably mounted to the supports 78, 79. The pair of speakers 72, 73 is operatively coupled to a signal source by any suitable means known in the art to permit a user to deploy the speakers into the ears of a user, if so desired.

Figure 15:
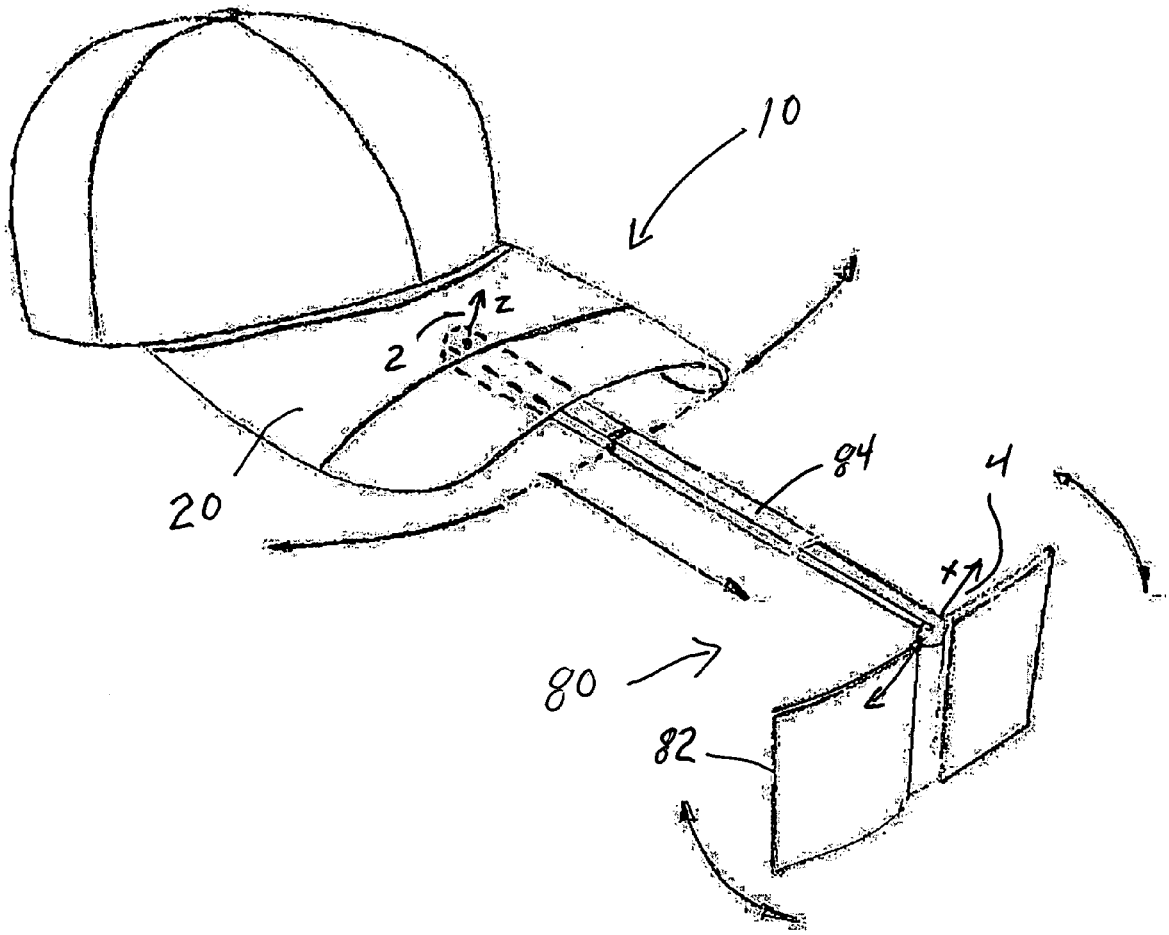
FIG. 15 is a perspective view of an alternative embodiment of the hat accessory of the present invention installed on the cap bill, having a video screen attached thereto.

Referring now to FIG. 15, a perspective view of an alternative embodiment of the hat accessory 10 of the present invention is shown having a display system 80 attached thereto. The system 80 includes a screen 82 pivotally attached to first end 83 of a selectively extendable boom 84. The boom 84 is pivotally attached at a second end 85 to a shaper strip 52, as shown in FIG. 7 or a display strip 60, as shown in FIG. 10. Video signals and power to illuminate the screen 82 may be provided to the screen 82 by any means known in the art, including electrical and optical conductors. In the preferred embodiment, power and video signals are conducted to the screen 82 through the boom 84, which is preferably a telescope design, in that one segment fits into another to extend or retract the screen 82. In the preferred embodiment, the screen 82 is curved to replicate the curve of the bill 18 when the hat accessory 10 is installed thereon.

The screen 82 is extendably adjustable via boom 84 to the users preference or comfort. Additionally, the boom 84 may pivot about a z-axis 2 to permit a user to position the screen. When not in use, the user may dispose the screen from sight by retracting the boom 84 and rotating the screen 82 about the x-axis 4 to position the screen 82 against the bill 18.

Figure 16:
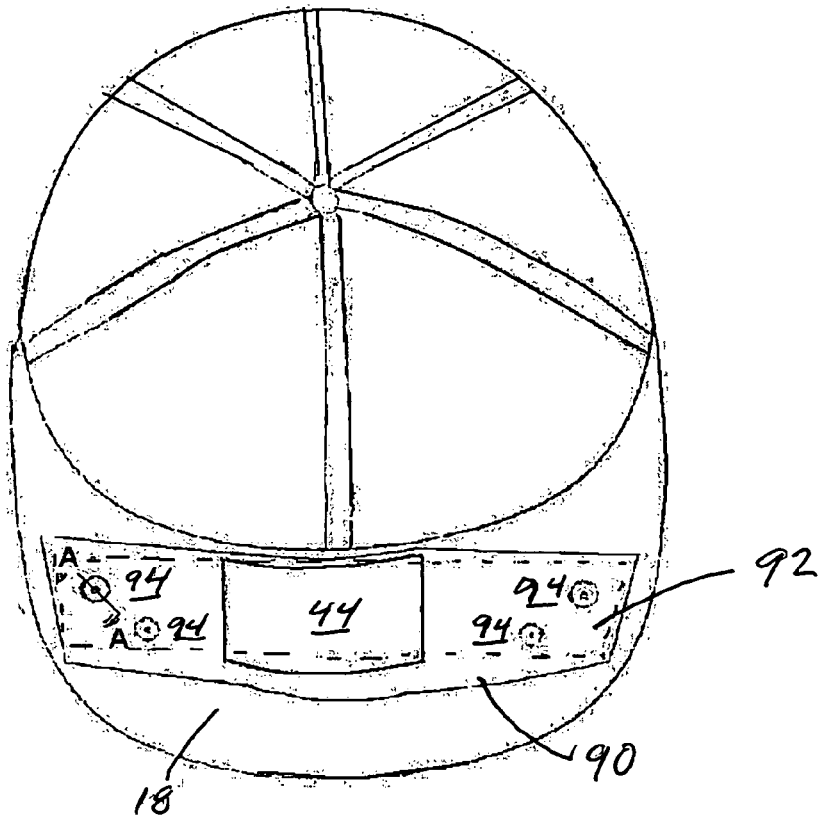
FIG. 16 is a perspective view of an alternative embodiment of the hat accessory of the present invention installed on the cap bill, with the crown as a separate component having a powered indicia disposed thereon and a separate shaper strip disposed on the underside of the bill, and a plurality of conductive fasteners for connecting the crown to the shaper strip through the bill.

Referring now to FIG. 16, a perspective view of an alternative embodiment of the hat accessory 10 of the present invention installed on the cap bill 18, with the crown 90 as a separate component having a powered indicia 44 disposed thereon and a shaper strip 92 disposed on the underside of the bill 18. A plurality of conductive fasteners 94 connect the crown 90 to the shaper strip 92 through the bill 18. The conductive fasteners 94 connect the crown 90 to the shaper strip 92 by any suitable fastener known in the art, including a spring clip type retainer and threaded fastener. In the preferred embodiment, the conductive fastener is selectively removable.

Figure 16A:
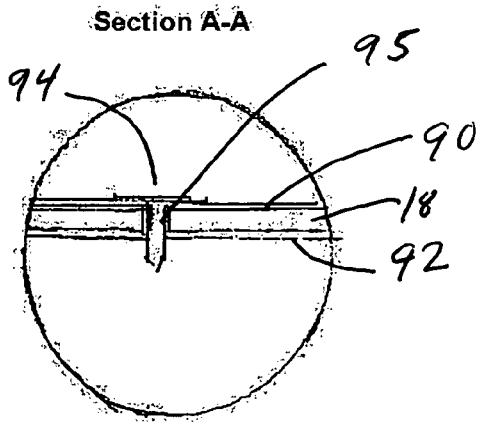
FIG. 16*a* is a partial cross sectional of the hat accessory of FIG. 16, cut through a conductive fastener.

Referring now also to FIG. 16*a,* a partial cross sectional of the hat accessory of FIG. 16 is shown, cut through a conductive fastener 94. The conductive fastener 94 contains one of an optically or electrically conductive element 95, which in the preferred embodiment is a layer disposed on the outside of the conductive fastener 94 to permit signals or power to be transferred between the crown 90 and shaper strip 92. The conductive fastener 94 is disposed to permit electrically or optically conductive material disposed in the crown 90 and shaper strip 92 to contact the conductive element 95. As set forth above, various electronic elements and power supply sources may be disposed on either the crown 90 or shaper strip 92.

Figure 17:
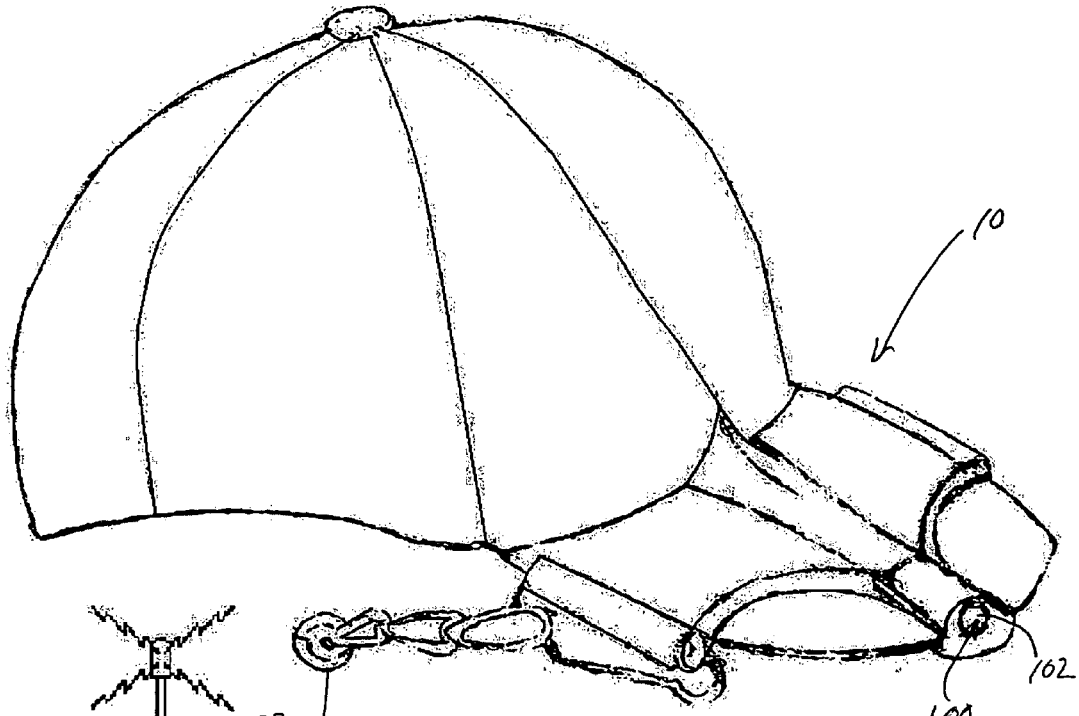
FIG. 17 is a perspective view of an alternative embodiment of the hat accessory of the present invention installed having a camera embedded therein.

Referring now also to FIG. 17, a perspective view of an alternative embodiment of the hat accessory 10 of the present invention is shown, having a camera 100 embedded therein. The camera 100 includes a lens 102 and a sensor array (not shown). In the present embodiment, the present invention 10 may also include a microphone 110 for receiving a sound and a transmitter (not shown) for transmitting a signal. In the preferred embodiment, the camera 100 is be embedded in the hat accessory 10 of the present invention. Electronics (not shown) may be included to control the camera 100.

Figure 18:
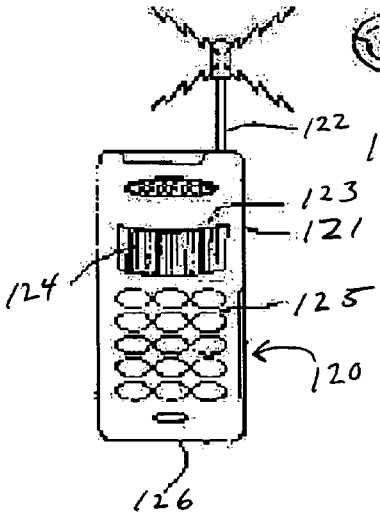
FIG. 18 is a front view of a wireless communications device provided to receive instructions to operate a hat accessory.

Referring now also to FIG. 18, a front view of a wireless communications device 120 is shown. In the present embodiment, the device 120 is a cellular phone. The wireless device 120 has electronics (not shown) and memory storage (not shown) enclosed within a housing 121. Wireless signals are sent and received via an antenna 122. The device 120 includes an input device such as a keypad 125 and a screen 123. Memory storage permits the device 120 to store a program containing instructions to control the camera 100 and display an image 124 on the screen 123. Although in the immediate embodiment, electronics generate a signal to control the camera 100 to transmit an image to the device 120 to be viewed on the screen 123, the device 120 may be adapted to control a number of devices included in the accessory 10. The device 120 is intended to include any suitable wireless communication device known in the art, including a cell phone or two way radio, as examples. The electronics may provide a signal to command the camera 100 to capture an image. The device 120 may receive the program through a port 126 or through the antenna 122, as examples. The program includes a code segment to provide instructions to display an image 124 on the wireless device screen 123 and to command the camera 100 to capture an image based on a user input.

The foregoing discussion discloses and describes the preferred structure and control system for the present invention. However, one skilled in the art will readily recognize from such discussion, and from the accompanying drawings and claims, that various changes, modifications and variations can be made therein without departing from the true spirit and fair scope of the invention as defined in the following claims.

What is claimed is:

1. A hat accessory for engaging a bill of a cap, comprising: an arcuate crown slightly greater in length than a width of a bill of a cap, said crown comprising an exposed upperside and an underside, an entire area of said underside contacting a top surface of the cap bill; a pair of retainer edge strips, each said edge strip extending from opposing ends of said crown, each said retainer edge strip removably binding a side edge of the cap bill; a pair of tabs, each said tab extending from each of said edge strips, said tabs being spaced from said crown to form a gap slightly smaller than the thickness of a cap bill for securely gripping a side edge portion of the cap bill, whereby said hat accessory is selectively secured to a cap bill by inserting the cap bill into said hat accessory where said tabs function to securely grip said hat accessory to the cap bill so that the cap may be worn by a user with the hat accessory attached thereto, wherein said hat accessory is a unitary device formed of a semi-rigid material, said hat accessory adapted to cause the cap bill and said crown of said hat accessory to conform to generally the same contour; and at least one means for communicating securely affixed to said exposed upperside of said crown.

2. The hat accessory for engaging a bill of a cap as set forth in claim 1, wherein said means for communicating is powered.

3. The hat accessory for engaging a bill of a cap as set forth in claim 2, wherein said means for communicating is electrically powered.

4. The hat accessory for engaging a bill of a cap as set forth in claim 1, wherein said means for communicating is magnetically attached to said crown.

5. The hat accessory for engaging a bill of a cap as set forth in claim 2, wherein said means for communicating includes a light emitting element.

6. The hat accessory for engaging a bill of a cap as set forth in claim 5, wherein said light emitting element is a light pipe.

7. The hat accessory for engaging a bill of a cap as set forth in claim 5, wherein said light emitting element is an electroluminescence device.

8. The hat accessory for engaging a bill of a cap as set forth in claim 7, wherein said light emitting element is an array of electroluminescence devices.

9. The hat accessory for engaging a bill of a cap as set forth in claim 1, further comprising an antenna.

10. The hat accessory for engaging a bill of a cap as set forth in claim 1, further comprising a photovoltaic device.

11. A hat accessory for engaging a bill of a cap, comprising:

an arcuate crown slightly greater in length than a width of a bill of a cap, said crown comprising an exposed upperside and an underside, an entire area of said underside contacting a top surface of the cap bill;

a shaper strip about equal in length to the width of a cap bill;

a pair of retainer edge strips, each said edge strip extending from opposing ends of said shaper strip, each said retainer edge strip removably binding a side edge of the cap bill;

a pair of crown retaining channels, said channels providing means to secure the crown to the shaper strip;

a pair of tabs, each said tab extending from each of said edge strips, said tabs being spaced from said crown to form a gap slightly smaller than the thickness of a cap bill for securely gripping a side edge portion of the cap bill, whereby said hat accessory is selectively secured to a cap bill by inserting the cap bill into said hat accessory where said tabs function to securely grip said hat accessory to the cap bill so that the cap may be worn by a user with the hat accessory attached thereto, wherein said hat accessory is formed of a semi-rigid material, said hat accessory adapted to cause the cap bill and said crown of said hat accessory to conform to generally the same contour; and at least one means for communicating securely affixed to said exposed upperside of said crown.

12. The hat accessory for engaging a bill of a cap as set forth in claim 11, wherein said means for communicating is powered.

13. The hat accessory for engaging a bill of a cap as set forth in claim 12, wherein said means for communicating is electrically powered.

14. The hat accessory for engaging a bill of a cap as set forth in claim 11, wherein said means for communicating is magnetically attached to said crown.

15. The hat accessory for engaging a bill of a cap as set forth in claim 12, wherein said means for communicating includes a light emitting element.

16. The hat accessory for engaging a bill of a cap as set forth in claim 15, wherein said light emitting element is a light pipe.

17. The hat accessory for engaging a bill of a cap as set forth in claim 15, wherein said light emitting element is an electroluminescence device.

18. The hat accessory for engaging a bill of a cap as set forth in claim 17, wherein said light emitting element is an array of electroluminescence devices.

19. The hat accessory for engaging a bill of a cap as set forth in claim 11, further comprising an antenna.

20. The hat accessory for engaging a bill of a cap as set forth in claim 11, further comprising a photovoltaic device.

* * * * *